United States Patent [19]

Simson

[11] 4,011,985

[45] Mar. 15, 1977

[54] COMBINED ADVERTISING INSERT AND MAILING ENVELOPE

[76] Inventor: Walter A. Simson, 230 Beverly Road, Scarsdale, N.Y. 10583

[22] Filed: Aug. 21, 1975

[21] Appl. No.: 606,362

[52] U.S. Cl. ..... 229/68 R; 229/73; 229/92.3; 283/6; 283/56

[51] Int. Cl.[2] ..... B65D 27/00; G09F 1/04

[58] Field of Search ..... 229/68 R, 73, 92.3, 229/92.1; 283/6, 56, 1 B

[56] References Cited

UNITED STATES PATENTS

| | | | |
|---|---|---|---|
| 1,957,374 | 5/1934 | Unger | 229/92.8 X |
| 2,109,603 | 3/1938 | Worth | 283/6 X |
| 2,279,164 | 4/1942 | Gettleman | 283/56 |
| 3,159,329 | 12/1964 | Hiersteiner | 229/68 R |
| 3,170,620 | 2/1965 | Nirenstein | 229/68 R |
| 3,275,316 | 9/1966 | Cleary, Jr. | 283/56 X |
| 3,807,771 | 4/1974 | Greason | 283/56 |

*Primary Examiner*—Stephen P. Garbe
*Attorney, Agent, or Firm*—Lackenbach, Lilling & Siegel

[57] ABSTRACT

A combined advertising insert and mailing envelope is formed from a single sheet which is folded so as to form a single thickness portion and a double thickness portion. The single thickness portion has a fold line which defines a flap, the fold line being coextensive with the crease lines of the pages of the magazine to position the flap and the balance of the insert, or the advertising page, on opposite sides of the saddle of a magazine. The advertising page is provided with a detachable envelope as well as with a plurality of flaps or sections on the double thickness portion which sections form windows. Each of the sections on one of the panels of the double thickness portion may be lifted to expose information printed on the other of the panels which is in registry with the window. The same insert, in some cases with slight modifications, is also suitable for insertion into perfect or adhesive bound magazines, and side-stitched magazines. Additionally, the insert of the present invention may be "blown" into any type of magazine or inserted into envelopes for direct mailing advertising.

12 Claims, 7 Drawing Figures

COMBINED ADVERTISING INSERT AND MAILING ENVELOPE

BACKGROUND OF THE INVENTION

This invention generally relates to advertising inserts for magazines, and more specifically to multi-purpose advertising inserts which are simple in construction and economical to manufacture, and which form a detachable envelope as well as windows for selectively exposing initially hidden information, and are suitable for magazine and direct mail advertising.

Numerous inserts for books and the like are known. Many of these are intended to serve as an advertising medium and some make provision for mail responses. Thus, some of the known magazine inserts are formed with various types of envelopes which may be detached from the insert and used for the purposes of responding to the advertisement. Examples of known inserts of the type under discussion are disclosed in the following U.S. Pat. Nos.

| | |
|---|---|
| 2,227,179 | Didier |
| 3,159,329 | Hiersteiner |
| 3,170,620 | Nirenstein |
| 3,347,449 | Behal |
| 3,560,025 | Ostrander |

Many of the prior art arrangements are quite complex in construction. Accordingly, the cost of manufacturing these is correspondingly high.

For the most part, the prior art inserts only provide simple printed advertising material on the inserts and a reply envelope or card is detachably formed with the insert. Also known are double thickness advertising sheets one of the sheets being provided with a removable or liftable tab which exposes printed information on the other sheet in registry with the resulting opening or window. The present invention discloses a simple and economical construction wherein a single sheet partially folded upon itself and selectively glued at the overlapping or coextensive portions provides both a detachable envelope, one or more windows for selectively exposing information, and a flap for placing the inserts into a saddle-stitch type magazine.

SUMMARY OF THE INVENTION

Accordingly, it is an object of the present invention to provide a combined advertising insert and mailing envelope which does not have the disadvantages of comparable prior art inserts.

It is another object of the present invention to provide an insert of the type under discussion which is simple in construction and economical to manufacture.

It is still another object of the present invention to provide an insert of the type suggested in the above objects, which provides both a detachable mailing envelope as well as a plurality of windows which selectively expose information.

It is yet another object of the present invention to provide an insert as in the last object, wherein one of the windows is formed with a removable tab which is in the nature of a coupon which may be completed and returned within the detachable envelope of the insert.

The present invention is for an advertising insert and for a blank for making the insert. The insert, in accordance with the present invention, comprises a generally rectangular advertising page. Said advertising page comprises first and second coextensive panels connected to each other at a fold line to form a double thickness page portion. Said first panel is wider than the said second panel to form a single thickness page portion extending beyond said double thickness portion. Said advertising page is provided with adhesive between said panels to join said panels to each other at selected portions thereof. Tear line means is provided on said advertising page. Said adhesive is provided along said tear line means to define an envelope detachable from said advertising page along said tear line means. At least one window means is provided in one of said panels for permitting the lifting of a portion of one of said panel to expose information in registry with the resulting opening on the other of said panels. The provision of a flap attached to said single thickness portion at a second fold line parallel to said first fold line makes the modified insert suitable for saddle-stitch type of magazines. Without the flap, the insert may be used in other types of magazines or in direct mail envelopes.

The blank of the invention comprises a generally rectangular sheet of flexible material, said sheet having a fold line to form a wide panel, and a narrow panel connected to said wide panel at said fold line. Tear line means is provided which extend over at least portions of said panels to define a detachable generally rectangular section. Window means is provided in at least one of said panels for permitting the lifting of a portion of the respective panel to form an opening therein. In this manner, folding of the panels about said fold line and selectively joining said panels to each other, causes said rectangular section to be formed into a detachable envelope and the lifting of a portion of the panel at said window means permits information provided on the other panel in registry with the resulting opening to become exposed and visible. A second fold line parallel to the first fold line may be provided to form a narrow flap connected to the wide panel for use in making inserts for saddle-stitch type of magazines.

The above, as well as other objects and advantages of the invention will become apparent from the following detailed description, reference being made to the accompanying drawings.

DESCRIPTION OF THE PREFERRED EMBODIMENT

Figure 1:
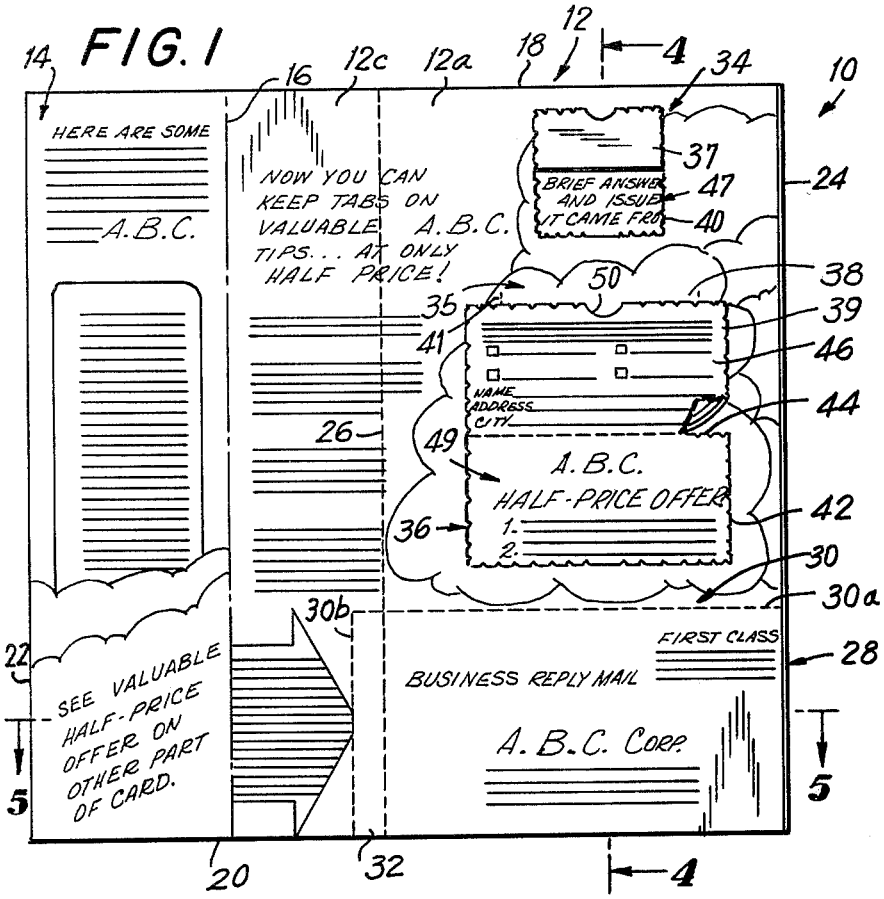
FIG. 1 is a front elevational view of a magazine insert in accordance with the present invention after a blank has been folded about a fold line and the two resulting coextensive panels selectively joined to one another to form a detachable envelope as well as window means for selectively exposing information.

Referring now specifically to the figures, wherein identical or similar parts are designated by the same reference numerals throughout, and first referring to FIG. 1, there is shown an insert 10 for magazines of the saddle-stitch type. The insert 10 may be made from paper, thin or light stock cardboard, or other similar thin and flexible materials.

While the insert 10 to be described is particularly suitable for saddle-stitch types of magazines, the same insert, in some cases with some slight modifications, may also be used for other types of magazines or for direct mail advertising, as to be more fully discussed below.

The insert 10 includes a generally rectangular advertising page 12 and a saddle flap 14 integrally formed with the advertising page at a vertical fold line 16, as viewed in FIG. 1. The flap 14 is also rectangularly shaped, although as will become evident from the description as follows, the specific shapes of the flap or the advertising page are not in and of themselves critical and may take on any desired shape or configuration.

The fold line 16 is generally coextensive with the crease lines of the pages of the magazine to position the flap 14 and the advertising page 12 on opposite sides of the saddle of the magazine when the insert is placed into the same.

Figure 2:
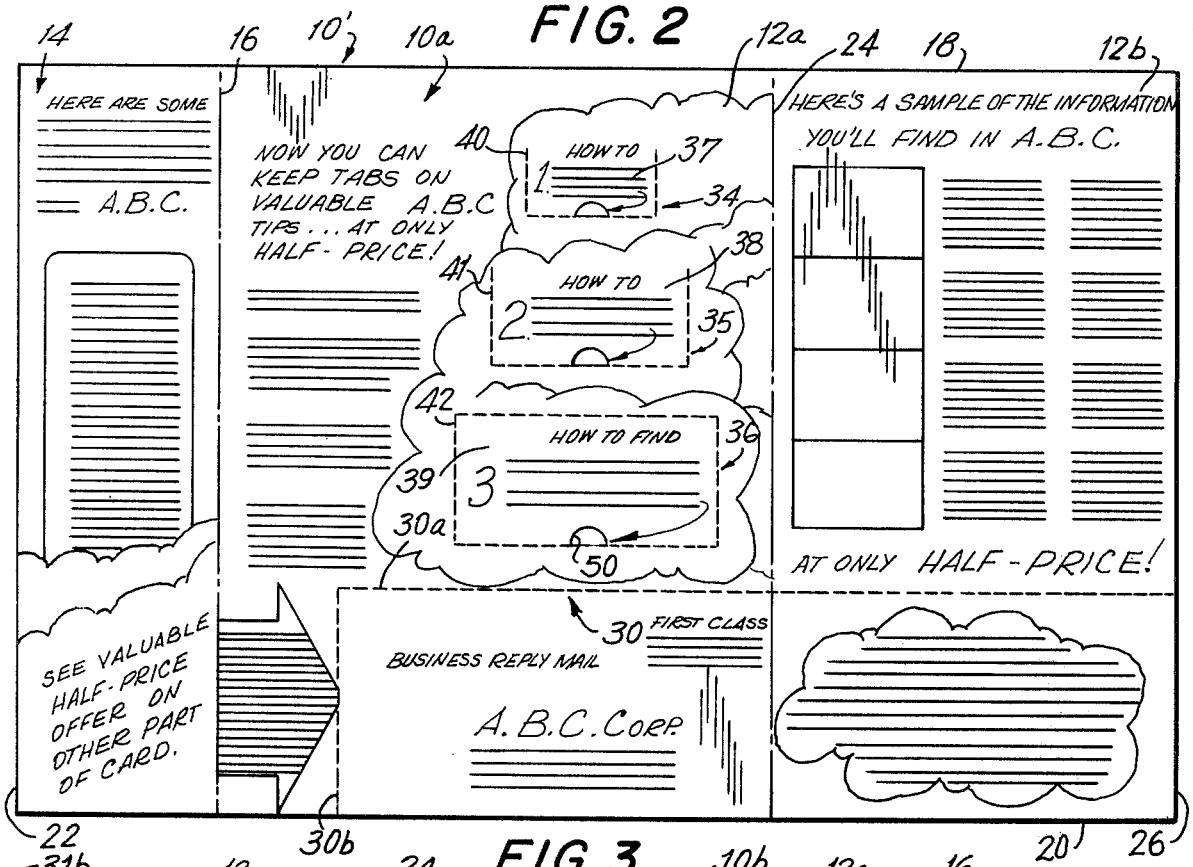
FIG. 2 is a front elevational view of the blank in accordance with the present invention, showing the fold lines and tear lines formed therein for forming the magazine insert shown in FIG. 1.
Figure 3:
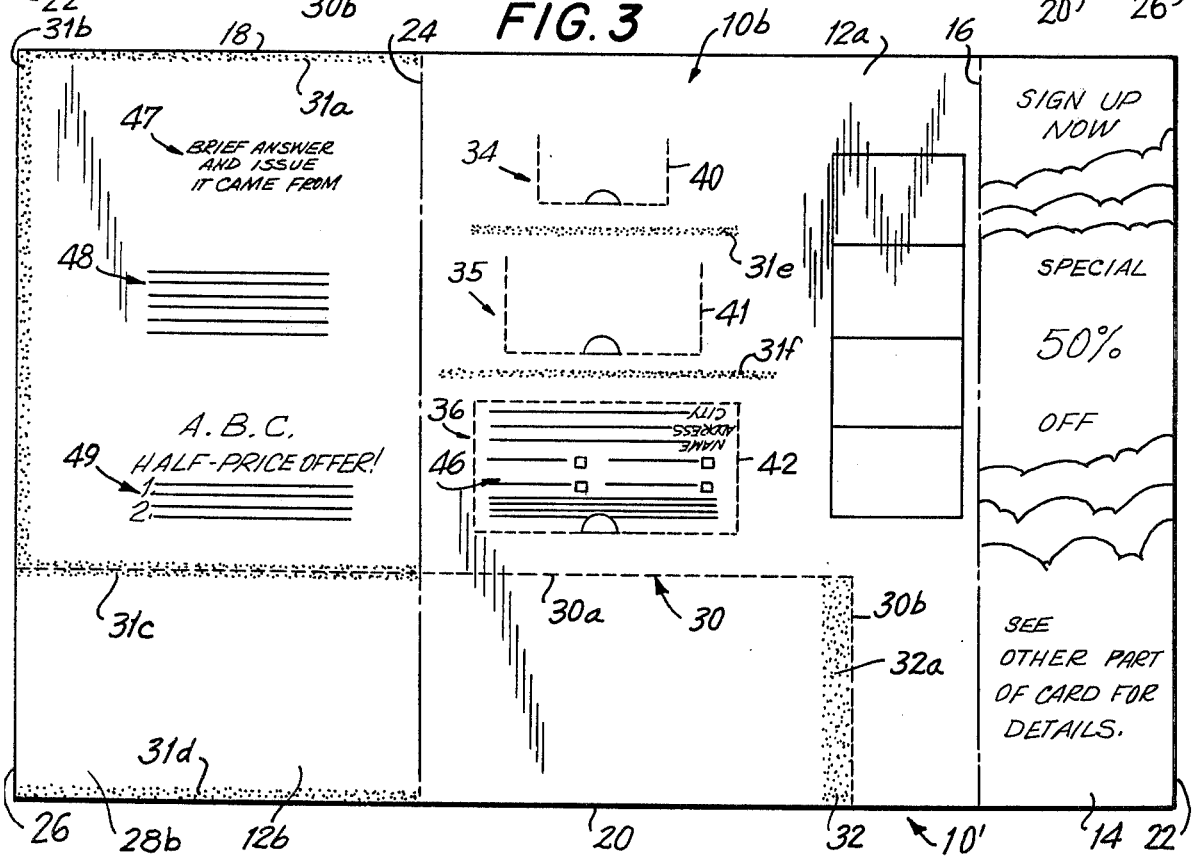
FIG. 3 is similar to FIG. 2 but showing the rear side of the blank.

The advertising page 12, as is the entire insert 10, is made from a single sheet of material. As above suggested, the specific dimensions of the sheet of material are not critical, since the inserts to be described may be variously shaped and dimensioned. The magazine insert 10 to be described by way of example, is made from an initial sheet which is approximately 11 inches by 17.75 inches. The initial sheet is rectangular and has an upper edge 18 and a lower edge 20, as viewed in FIG. 1. Once the insert 10 is assembled, there is defined a left-hand edge 22 as well as a right-hand edge 24 which is in the nature of a fold line. As best shown in FIGS. 2 and 3, the initial sheet from which the insert 10 is made has a right-hand edge 26 which is parallel to the edge 22. The fold lines 16 and 24 are similarly parallel to the edges 22 and 26.

As best depicted in FIGS. 2 and 3, the unfolded blank 10′ from which the insert 10 is formed, includes the flap 14 as above described and includes a panel 12*a*, which shall be referred to as a front panel for references purposes, and a rear panel 12*b*. The front and rear panels are integrally formed and meet at the fold line 24. The front panel 12*a* has a width greater than the rear panel 12*b* so that when the panels are brought into coextensive relationship, as shown in FIG. 1, by folding of the rear panel 12*b* relative to the front panel 12*a* about the fold line 24, there is formed a double thickness page portion having a width corresponding to that of the rear panel 12*b* and which extends in FIG. 1 between the dashed representation of the edge 26 and the edge or fold line 24. However, because of the difference in width of the panels 12*a* and 12*b*, there is also formed a single thickness page portion between the flap 14 and the double thickness portion and more specifically between the fold line 16 and the dashed line representation of the edge 26 in FIG. 1. As can best be appreciated from an examination of FIGS. 1, 2 and 3, the magazine insert 10 is formed by merely folding the rear panel 12*b* of the single sheet of material about the fold line 24 to bring the same coextensively behind the front panel 12*a*. Accordingly, it should be evident that the manufacture of the insert is extremely simple and economical. The other steps required in the formation of the insert 10 are similarly simple and permit a most economical construction for magazine inserts.

An envelope as generally designated by the reference numeral 28 is shown in FIG. 1 as being formed primarily by the juxtaposed front and rear panels 12*a* and 12*b*. Referring additionally to FIGS. 2 and 3, the envelope 28 is formed by providing tear lines 30 which may be in the form of perforations. The tear line 30 extends across the entire width of the narrow panel 12*b* and across the substantial part of the front panel 12*a*. More specifically, a first tear line 30*a* is provided which extends parallel to the upper and lower edges 18, 20 and extends across the entire rear panel 12*b* as well as across the front panel 12*a* for a distance greater than the width of the rear panel 12*b*. In this way, when the rear panel 12*b* is folded behind the rear panel 12*a*, the tear line or perforations 30*a* extend beyond the double thickness portion of the advertising page 12 or beyond the dashed edge line representation 26. Thus, the tear line 30*a* extends beyond the double thickness portion of the advertising page 12 and to an intermediate point of the single thickness portion between the fold line 16 and the double thickness portion of the dashed line representing the edge 26 in FIG. 1. The tear line 30*b* then extends downwardly parallel to the fold line 16 to the lower edge 20 as shown in FIGS. 1 and 2. The tear lines 30*a* and 30*b* thereby form a detachable, generally rectangular portion extending across the panels 12*a* and 12*b* as viewed in FIGS. 2 and 3.

Adhesive is provided between the panels 12*a* and 12*b* to join the panels to each other at selective portions thereof. The adhesive is provided on the rear side 10*b* of the panel 12*b*, as best shown in FIG. 3. Thus, there is provided a strip of glue 31*a* along the upper edge 18 and extending between the fold line 24 and the end edge 26 of the blank. A strip of glue 31*b* is provided which extends from the glue line 31*a* along the edge 26 to the tearline 30*a*. Glue strips 31*c* and 31*d* extend between the edge 26 and the fold line 24, the strip 31*c* being sufficiently wide to extend to both sides of the tear line 30*a* while the strip of glue 31*b* extends along the lower edge 20. Strips of glue 31*e* and 31*f* are illustrative of additional glue strips which may be utilized to join the front and rear panels 12*a* and 12*b* to each other to prevent separation or sagging between the panels but without interfering with the windows to be described below. Clearly, the strips 31*e* and 31*f* are only illustrative of how additional glue portions may be provided to improve the integrity of the completed or assembled magazine insert 10. As will become clear to those skilled in the art, additional glue portions may be provided as required or as may be expedient with the machinery being utilized to apply the glue. The glue which is applied may, of course, be of any suitable type of pocket glue, including temperature sensitive, pressure sensitive, or the like.

Figure 6:
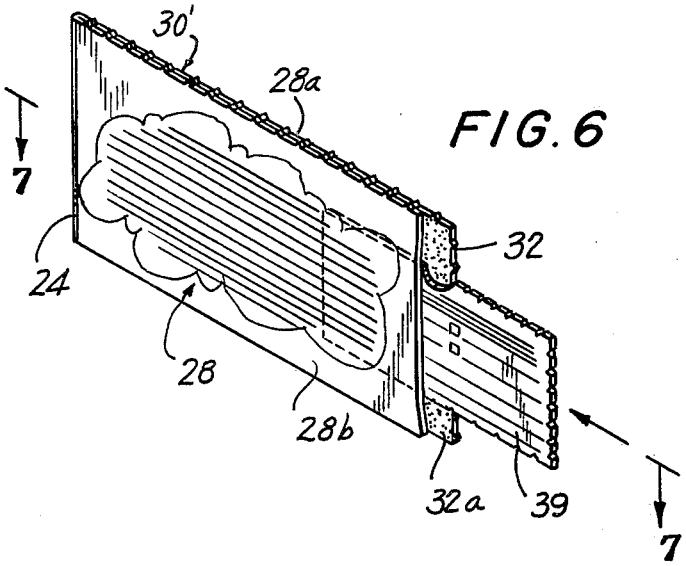
FIG. 6 is a perspective view of the envelope detached from the magazine insert shown in FIG. 1, further showing one of the flaps forming a window of the insert removed and used as a reply coupon which is receivable within the envelope.
Figure 7:
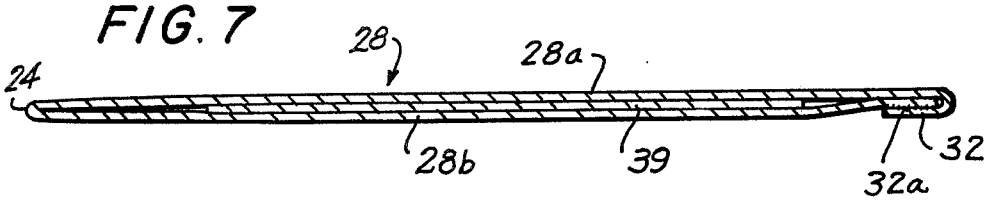
FIG. 7 is a cross-sectional view of the envelope and coupon shown in FIG. 6, showing the coupon fully received within the envelope and the envelope flap folded and sealed.

When the blank is folded the panels 12*a* and 12*b* are brought into coextensive relation and when the glue strips or portions have been activated, the panels may be joined to one another. An important feature of the present invention is that the resulting envelope 28 must only be glued at two opposing edges thereof, the third edge being formed by the fold line 24. The envelope 28 is thereby closed along three edges thereof and forms an opening at the fourth edge thereof where the double thickness portion of the advertising page terminates. The portion of the rectangular section defined by the tear line 30 which extends beyond the double thickness portion forms a flap 32 for the envelope which is provided with re-moistenable glue 32*a*. Referring to FIGS. 6 and 7, the envelope 28 may be detached from the advertising page 12 by separation along the tear line 30. The flap 32, formed within the single thickness portion of the advertising page may thereby be folded onto the double thickness portion and sealed thereto to close the envelope opening as shown in FIG. 7.

The juxtaposition of the panels 12*a* and 12*b*, in addition to forming an envelope as above described, also permits the formation of at least one window in one of the panels for permitting the lifting of a portion of that panel to expose information printed on and in registry with the resulting opening on the other of the panels. First referring to FIGS. 2 and 3, there are shown three windows 34–36 which are formed within the front panel 12*a*. Each of the windows is formed by providing perforations on the front panel 12*a* to define a generally rectangular portion or flap 37, 38 or 39 which is severable from the panel 12*a* along three edges thereof by tear lines 40, 41 or 42. Each rectangular portion 37–39 may be folded with respect to the front panel 12*a* at a fold line. In this manner, severance of a rectangular portion from the front panel 12*a* at the three edges as shown permits the rectangular portion to be folded and lifted about the fold line at the fourth upper edge to create a generally rectangular window for exposing information in registry with the resulting opening on the other panel.

In accordance with the presently preferred embodiment, at least one of the flaps 37–39 are fully detachable from the front panel 12*a* by severance along a tear line along the fourth edge 44. This is suggested in FIG. 1. As described above, after the panels are joined with adhesive strips, the envelope 28 exhibits a receiving compartment. By selecting the dimensions of the rectangular portion or flap 39 to correspond with the internal dimensions of the receiving compartment of the envelope, the flap 39 may be received therein. By imprinting the rear surface 10*b* of the flap 39 with a printed form 46, the flap 39 is in the nature of a coupon or order blank which may be inserted into the envelope which has been detached from the advertising page 12 and mailed to an advertiser in the envelope.

The unfolded blank 10′ has a front surface 10*a* and a rear surface 10*b*. By imprinting the rear surface 10*b* of the rear panel 12*a* with text material 47, 48 and 49 at selected positions thereof, the text 47–49 is aligned or placed behind or in registry with the flaps 37–39 when the rear panel is folded behind the front panel as shown in FIG. 1. The use of windows 34–36 of the type suggested is very suitable for a question and answer-type of format wherein a question may be imprinted on the front surface 10*a* of the front panel 12*a*and the answer is concealed behind the respective flaps 37–39 until these flaps are lifted to expose the text 47–49 respectively. While only one window may be used, it is also possible to provide a plurality of windows, with differently sized or differently shaped flaps. The number of such windows clearly is limited only by the surface area provided by the double thickness portion of the advertising page 12. Advantageously, each of the windows 34–36 is provided with gripping means for facilitating the gripping and lifting of the flaps 37–39. As shown in the Figures, the gripping means used in the presently preferred embodiment is in the form of a semi-circular cut-out portion 50 of the flaps provided along the lower edges of the same to permit the insertion of a finger below the flap and therefore to facilitate the gripping of the flap and lifting of the same while separating the flap from the panel along the tear lines.

Clearly, the bulk of the advertising appears on the advertising page 12 as opposed to the flap 14 and therefore the width of the flap is advantageously substantially less than the width of the advertising page. Additionally, the single thickness portion of the advertising page may also be relatively narrow so long as it is wide enough to form a sufficiently wide envelope flap 32. As suggested above, the size of the inserts 10 or the dimensions thereof are not in and of themselves critical. For the suggested size of a blank 10′ of 11 inches by 17.75 inches, the saddle flap 14 may, for example, be made approximately 3.2 inches while the entire width of the advertising page 12 between the fold line 16 and the edge or fold line 24 may be approximately 8.5 inches. With these dimensions, the single thickness portion of the advertising page is approximately 2.3 inches. It has been found that a magazine insert having these general dimensions is satisfactory and may be inserted into standard-sized saddle-type magazines.

As will be appreciated, the provision of glue strips 31*e* and 31*f* or the equivalents thereof between the various windows 34–36 permits the lifting of the respective flaps without separating the two coextensive panels 12*a*, 12*b* and, as mentioned above, prevents sagging of the advertising page 12.

Figure 4:
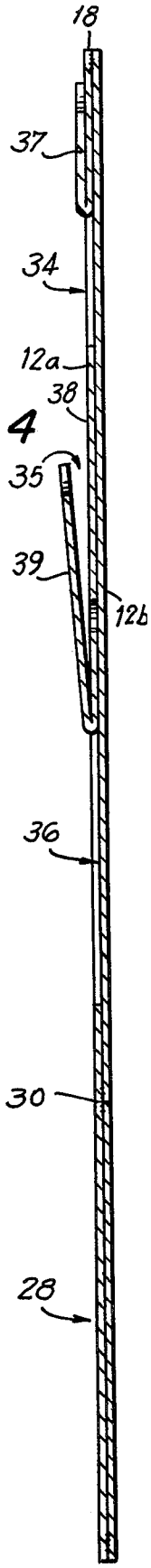
FIG. 4 is an enlarged cross-sectional view of the magazine insert shown in FIG. 1, taken along line 4—4.
Figure 5:
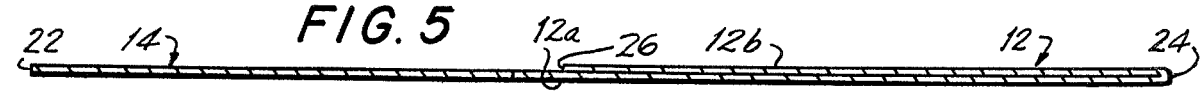
FIG. 5 is an enlarged cross-sectional view of the magazine insert shown in FIG. 1, taken along line 5—5.

Referring to FIGS. 4 and 5, the double thickness portion of the advertising page 12 is shown in cross-section to indicate the simplicity and versatility of the insert 10. By imparting perforations on the blank 10′ as suggested in FIGS. 2 and 3 in a first step after or before the printing has been applied on the front and rear surfaces 10*a* and 10*b*, adhesive strips are applied to the blank 10′ and only one folding step is required, namely the folding about the fold line 24 of the blank to bring the rear panel 12*b* into juxtaposition with the front panel 12*a*. This extremely simple operation results in an insert 10 for saddle-type magazines which provides advertising both on the saddle flap 14 as well as on the advertising page 12. The advertising page 12 provides not only simple printed matter but offers a question-answer format by the use of the windows 34–36. By providing perforations or tear lines about the entire periphery of one of the window flaps, this flap may be detached from the insert and may be used as a coupon or inquiry blank which may be imprinted with a form to be filled out prior to insertion into the envelope 28 prior to mailing to the advertiser. As will be appreciated, the magazine insert of the present invention is extremely simple in construction and economical to manufacture and yet provides a plurality of advantageous features which are most desirable in magazine inserts of this type.

What has been described above is an insert 10 provided which an end or saddle flap 14 suitable for use with saddle-stitched type of magazines. As suggested above, however, the invention is not limited to this single application. For example, by omitting the flap 14, the insert can be bound in perfect or adhesive bound magazines, as well as in side-stitched magazines. In each case, the single thickness portion may be aligned with the edges of the other pages to be bound and joined to the latter either by the use of adhesive at the edges thereof or by driving stitching or staples through the respective edges.

The insert of the present invention also lends itself to being used in modern advertising techniques. Thus, if the dimensions are selected to fit the appropriate machinery, the inserts can be "blown" between the pages of any magazine. Additionally, the insert may be inserted into envelopes for direct mail advertising.

While a presently preferred embodiment has been described, it will nevertheless be understood that this is only exemplary and that modifications may be made without departing from the spirit of the invention as defined by the claims that follow. For example, the specific location of the windows 34–36 or the envelope 28. or both, is not critical and may be changed by moving the positions of the respective tear lines as will be evident to those skilled in the art. Thus, the envelope 28 need not be located in one corner of the double thickness portion. Instead, as an alternate embodiment, the tear line for the envelope may extend the entire height of the double thickness portion, such as by running a tear line parallel to the fold line 24 between the edges 18, 20. Numerous other arrangements using the simple principle of the present invention will become evident to those skilled in the art based on the above disclosure.

What is claimed is:

1. An insert for a magazine of the saddle stitch type, comprising a flap; a generally rectangular advertising page connected to said flap along a first fold line which fold line is generally coextensive with the crease lines of the pages of the magazine to position said flap and said advertising page on opposite sides of the saddle of the magazine when the insert is placed into the same, said advertising page comprising first and second overlapping panels connected to each other at a second fold line substantially parallel to said first fold line, said first panel being wider than said second panel to form a double thickness page portion and a single thickness page portion which is between said flap and said double thickness portion; tear line means extending from said second fold line to a point beyond said double thickness portion to delineate one side of an envelope pocket on said double thickness portion and a closure tab on said single thickness portion, said tear line means generally separating said double thickness portion into an envelope panel portion and a window panel portion; a plurality of window means in one of said panels of said window panel portion for permitting the lifting of a portion of one of said panels to expose information in registry with the resulting opening on the other of said panels, said window means generally being spaced from each other along a predetermined direction; and adhesive means joining said first and second panels to each other at selected portions thereof, said adhesive means including adhesive strips provided along the edges of said window panel portion along and on both sides of a portion of said tear line means, along said envelope pocket, and along said closure tab, adhesive strips being provided and oriented generally normally to said predetermined direction between adjacent window means, whereby said first and second panels are connected to each other substantially about the peripheries of each of said window means.

2. An insert as defined in claim 1, wherein said tear line means comprises perforations in said panels.

3. An insert as defined in claim 1 wherein the width of said flap is substantially less than that of said panels.

4. An insert as defined in claim 1 wherein at least one window means comprises a generally rectangular portion of a panel, said rectangular portion being connected to the respective panel at three edges thereof by tear lines and at the fourth edge by a fold line, whereby severance of said rectangular portion from the respective panel at said three edges permits said rectangular portion to be folded and lifted about said fold line at said fourth edge to create a generally rectangular window or opening in said respective panel.

5. An insert as defined in claim 4, wherein said fold line at said fourth edge is also provided with a tear line, whereby said rectangular portion may be removed from the respective panel to form said window.

6. An insert as defined in claim 5, wherein said detachable envelope has a receiving compartment or pocket, and wherein said rectangular portion is removable from said respective panel and has dimensions selected to be receivable within said envelope compartment, whereby said rectangular portion is in the nature of a response or reply coupon which can be mailed to an advertiser in said envelope.

7. An insert as defined in claim 1, wherein said plurality of window means are all spaced from each other along said predetermined direction.

8. An insert as defined in claim 7, wherein each of said window means is dimensioned to define a differently sized opening.

9. An insert as defined in claim 1, wherein said rectangular portion is provided with a gripping means for facilitating the gripping and lifting of the same.

10. An advertising insert comprising a generally rectangular advertising page, comprising first and second overlapping panels connected to each other at a fold line, said first panel being wider than said second panel to form a double thickness page portion and a single thickness page portion extending beyond said double thickness portion; tear line means provided on said advertising page to delineate one side of an envelope which is detachable from said advertising page along said tear line means, said envelope including a pocket on said double thickness portion and a closure tab on said single thickness portion, said tear line means generally separating said double thickness portion into an envelope panel portion and a window panel portion; a plurality of window means in one of said panels of said window panel portion for permitting the lifting of a portion of one of said panels to expose information in registry with the resulting opening on the other of said panels, said window means generally being spaced from each other along a predetermined direction; and adhesive means including adhesive strips provided along the edges of said window panel portion, along said tear line means, along said envelope pocket, and along and on both sides of a portion of said closure tab, adhesive strips being provided and oriented generally normally to said predetermined direction between adjacent window means, whereby said first and second panels are connected to each other substantially about the peripheries of each of said window means.

11. A blank for a magazine insert comprising a generally rectangular sheet of flexible material, said sheet having first and second parallel fold lines spaced from each other to form a relatively narrow flap, a wide panel connected to said flap at said first fold line, and a narrow panel connected to said wide panel at said second fold line, tear line means provided which extend over the entire width of said narrow panel, across said second fold line and over a width of said wide panel greater than that of said narrow panel to define a detachable generally rectangular section; and a plurality of window means in at least one of said panels for permitting the lifting of a portion of the respective panel to form an opening therein, said window means generally being spaced from each other along a predetermined direction; said tear line means generally separating said panels into an envelope panel portion and a window panel portion; and adhesive strips provided along the edges of said window panel portion and along selected portions of said rectangular section, adhesive strips being provided and oriented normally to said predetermined direction between adjacent window means, whereby folding said panels about said second fold line and selectively joining said panels to each other, including substantially about the peripheries of said window means, causes said rectangular section to be formed into a detachable envelope and the lifting of a portion of a panel permits information provided on the other panel in registry with the resulting opening to become exposed and visible.

12. A blank for a magazine insert comprising a generally rectangular sheet of flexible material, said sheet having a fold line to form a wide panel and a narrow panel connected to said wide panel at said fold line, tear line means being provided which extend over at least portions of said panels to define a detachable generally rectangular section; and a plurality of window means in at least one of said panels for permitting the lifting of a portion of the respective panel to form an opening therein, said window means generally being spaced from each other along a predetermined direction; said tear line means generally separating said panels into an envelope panel portion and a window panel portion; and adhesive strips provided along the edges of said window panel portion and along selected portions of said rectangular section, adhesive strips being provided and oriented normally to said predetermined direction between adjacent window means, whereby folding said panels about said fold line and selectively joining said panels to each other, including substantially about the peripheries of said window means, causes said rectangular section to be formed into a detachable envelope and the lifting of a portion of a panel permits information provided on the other panel in registry with the resulting opening to become exposed and visible.

* * * * *